US008122547B2

(12) United States Patent
Park

(10) Patent No.: US 8,122,547 B2
(45) Date of Patent: Feb. 28, 2012

(54) WASHING MACHINE AND METHOD FOR CONTROLLING THE SAME

(75) Inventor: Seok Kyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 944 days.

(21) Appl. No.: 11/034,880

(22) Filed: Jan. 14, 2005

(65) Prior Publication Data

US 2006/0016020 A1 Jan. 26, 2006

(30) Foreign Application Priority Data

Jul. 20, 2004 (KR) ..... 10-2004-0056202
Jul. 20, 2004 (KR) ..... 10-2004-0056203
Oct. 25, 2004 (KR) ..... 10-2004-0085321

(51) Int. Cl.
*D06F 39/00* (2006.01)

(52) U.S. Cl. ..... 8/149.3; 8/149.1; 8/158; 68/5 R; 68/12.01

(58) Field of Classification Search ..... 8/149, 149.1, 8/149.2, 149.3, 158, 159; 68/3 R, 4, 5 R, 68/12.01, 58, 5 C
See application file for complete search history.

(56) References Cited

U.S. PATENT DOCUMENTS 2,055,254 A * 9/1936 Hanney ..... 68/12.01
3,402,576 A * 9/1968 Krupsky ..... 68/4
3,443,406 A * 5/1969 Hornback et al. ..... 68/58
5,050,259 A 9/1991 Tsubaki et al.
5,561,992 A * 10/1996 Carloni ..... 68/16
5,689,848 A * 11/1997 Saal et al. ..... 8/159
2004/0255391 A1 * 12/2004 Kim et al. ..... 8/149.3
2005/0144734 A1 7/2005 Yang et al.

FOREIGN PATENT DOCUMENTS

| | | | |
|---|---|---|---|
| DE | 197 43 508 | A1 | 4/1999 |
| EP | 0 240 910 | A2 | 10/1987 |
| EP | 0816550 | A1 | 1/1998 |
| EP | 1 275 767 | A1 | 1/2003 |
| EP | 1 302 586 | A1 | 4/2003 |
| EP | 1 469 120 | A1 | 10/2004 |
| EP | 1 555 338 | A2 | 7/2005 |
| EP | 1555339 | A2 | 7/2005 |
| EP | 1555340 | A2 | 7/2005 |
| EP | 1 657 348 | A2 | 5/2006 |
| GB | 1 526 095 | | 9/1978 |
| JP | 4-158896 | A | 6/1992 |
| JP | 2000-176192 | A | 6/2000 |
| JP | 2002-360987 | A | 12/2002 |
| JP | 2003-093775 | A | 4/2003 |
| JP | 2004-167131 | | 6/2004 |
| KR | 10-0172929 | B1 | 10/1998 |
| KR | 2003-0034502 | A | 5/2003 |
| KR | 2004-0015957 | A | 2/2004 |
| KR | 2004-0088884 | A | 10/2004 |
| SU | 1481303 | | 5/1989 |

* cited by examiner

*Primary Examiner* — Michael Barr
*Assistant Examiner* — Benjamin Osterhout
(74) *Attorney, Agent, or Firm* — Birch, Stewart, Kolasch & Birch, LLP

(57) ABSTRACT

A washing machine includes a main body defining an outer appearance, a tub supported in the main body, a drum rotatably installed in the tub, a steam generating unit supplying steam into the drum, and a circulation pump returning washing water exhausted from a first side of the tub to a second side of the tub.

18 Claims, 9 Drawing Sheets

WASHING MACHINE AND METHOD FOR CONTROLLING THE SAME

This application claims the benefit of the Korean Application No. P2004-56202; P2004-56203 both filed on Jul. 20, 2004 and P2004-85321 filed on Oct. 25, 2004 which are hereby incorporated by reference.

BACKGROUND OF THE INVENTION

1. Field of the Invention

The present invention relates to a washing machine, and more particularly, to a washing machine and method for controlling the same, which are designed to save washing water and prevent damage of the laundry, which may be caused by temperature increase for the washing operation.

2. Discussion of the Related Art

Generally, a drum-type washing machine is a device performing the washing by dropping laundry loaded in a horizontally disposed drum.

FIG. 1 shows a prior drum-type washing machine and FIG. 2 shows another prior drum-type washing machine.

Referring to FIG. 1, a drum-type washing machine includes a main body 10, a tub 20 mounted in the main body 10, a drum 30 rotatably mounted in the tub 20, and a driving unit for driving the drum 30.

Here, the main body 10 is provided at a front portion with a laundry loading opening 11, around which a door 40 for opening/closing the opening 11 is mounted.

A gasket 50 is disposed on an inner circumference of the laundry loading opening 11 to provide a seal between the door 40 and the laundry loading opening 11.

A damper 21 is provided on an outer-lower portion of the tub 20 and supported in the main body 10.

The driving unit includes a driving motor 71 driving the drum 30 and a belt 72 connected to a belt pulley 73 to transmit driving force of the driving motor 71 to the drum 30.

If the drum-type washing machine has a dry function, as shown in FIG. 2, a hot wind supply tube 81 is provided above the tub 20 and a dry heater 82 is disposed in the hot wind supply tube 81 to heat air flowing along the hot wind supply tube 81.

Disposed on an air exhaust side of the hot wind supply tube 81 is a blower fan 83 for forcedly circulating the air.

However, in the prior drum-type washing machines, even when washing the laundry that is less stained and thus a little amount of water is required, a large amount of water is consumed. Furthermore, the washing operation is identically performed to a case for normal washing operation, increasing the consumption of the electricity.

Furthermore, in the case of the washing machine with the dry function, the laundry may be wrinkled or static electricity may occur.

SUMMARY OF THE INVENTION

Accordingly, the present invention is directed to a washing machine and method for controlling the same that substantially obviate one or more problems due to limitations and disadvantages of the related art.

An object of the present invention is to provide a washing machine and method for controlling the same, which are designed to save washing water and prevent damage of the laundry, which may be caused by temperature increase for the washing operation.

Another object of the present invention is to provide a washing machine and method for controlling the same, which can prevent the wrinkle of the laundry and the generation of the static electricity, which may be caused during the dry operation.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine includes: a main body defining an outer appearance; a tub supported in the main body; a drum rotatably installed in the tub; a steam generating unit supplying steam into the drum; and a circulation pump returning washing water exhausted from a first side of the tub to a second side of the tub.

In another aspect of the present invention, there is provided a washing machine, including: a main body defining an outer appearance; a tub supported in the main body; a drum rotatably installed in the tub; a steam generating unit supplying steam into the drum; a circulation pump returning washing water exhausted from a first side of the tub to a second side of the tub; and a dry unit for drying laundry after washing operation is finished.

In a further another aspect of the present invention, there is provided a method for controlling a washing machine with a circulation pump circulating washing water and a steam generating unit, the method including the steps of supplying the washing water; increasing an inner temperature of a drum by supplying steam into the drum; repeating washing water supply/circulation process when the temperature is increased to a predetermined level; and repeating the above steps to gradually increase the inner temperature of the drum.

In a still further another aspect of the present invention, there is provided a method for controlling a washing machine with a circulation pump circulating washing water and a steam generating unit, the method including the steps of: supplying the washing water; increasing an inner temperature of a drum by supplying steam into the drum; detecting the inner temperature of the drum as the steam is supplied into the drum; comparing a detected temperature value with a reference temperature value; repeating a washing water circulation process after stopping a heating operation for generating the steam when the detected temperature value is identical to the reference temperature value; and repeating the above steps during a washing operation.

In a still yet another aspect of the present invention, there is provided a method for controlling a washing machine with a circulation pump circulating washing water and a steam generating unit, the method including the steps of: supplying the washing water; performing a heating operation for a predetermined time to direct the steam into the drum; repeating a washing water supply/circulation process after stopping the heating operation for generating the steam when the predetermined time has elapsed; and repeating the above steps during a washing operation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
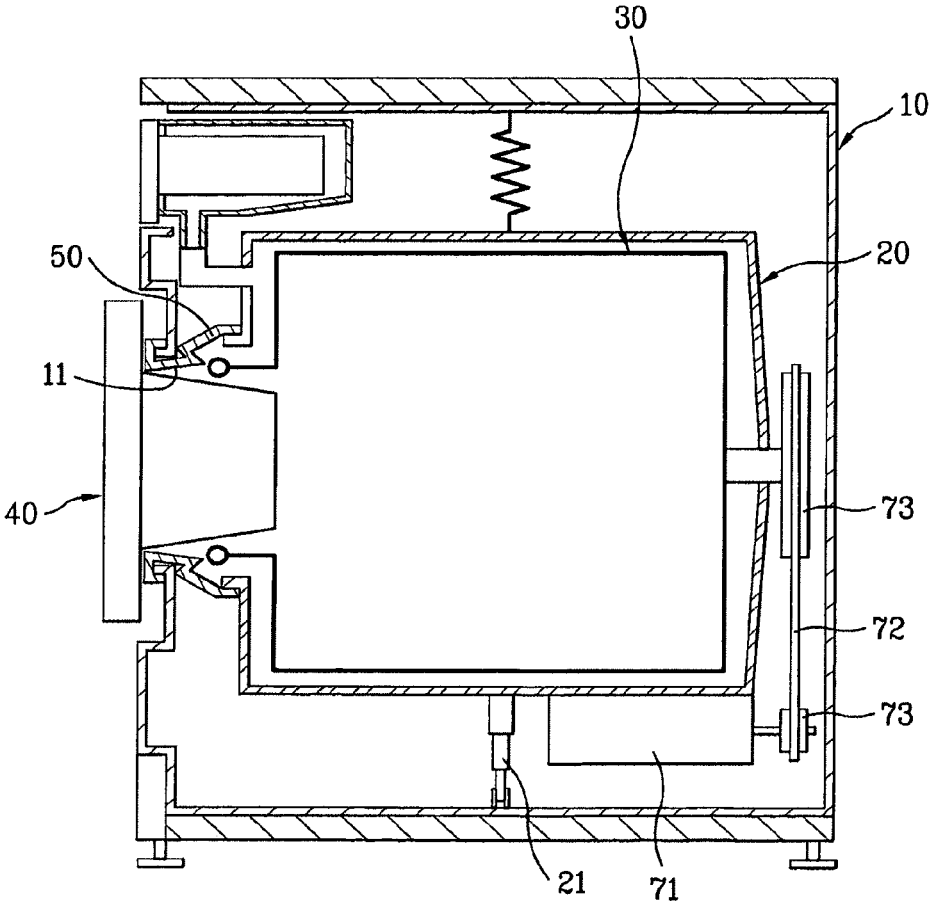
Prior Art FIG. 1
FIG. 1 illustrates a prior drum-type washing machine.
Figure 2:
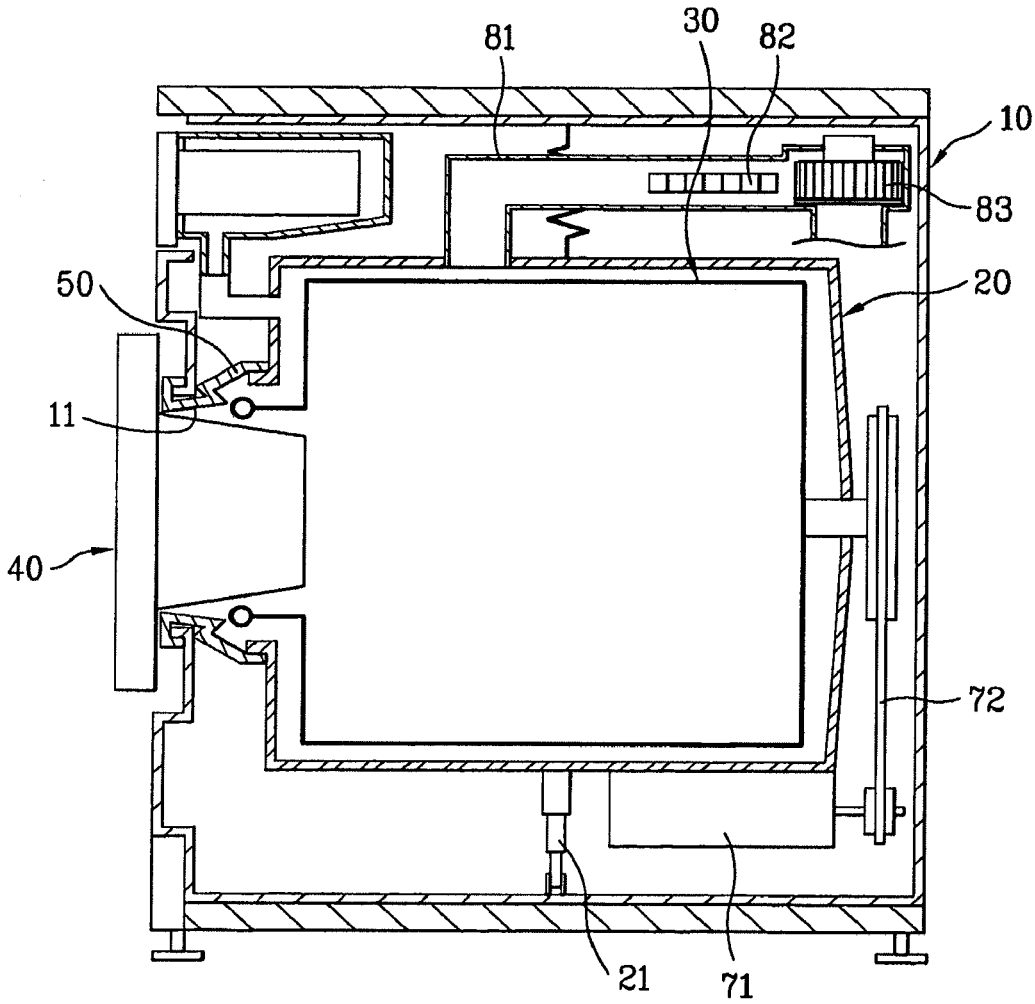
Prior Art FIG. 2
FIG. 2 illustrates another prior drum-type washing machine.
Figure 3:
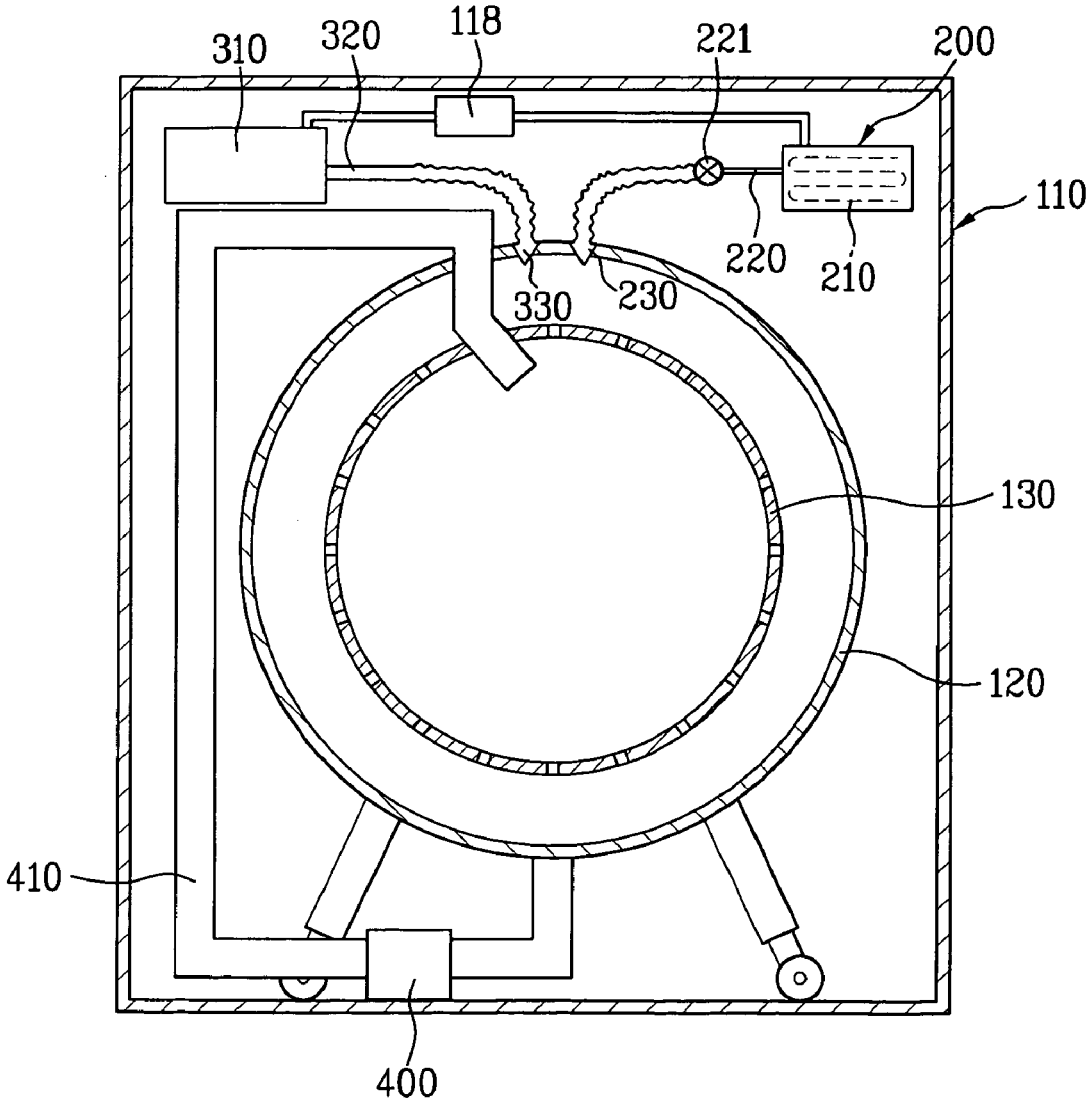
FIGS. 3 and 4 illustrate an internal structure of a drum-type washing machine according to an embodiment of the present invention.
Figure 4:
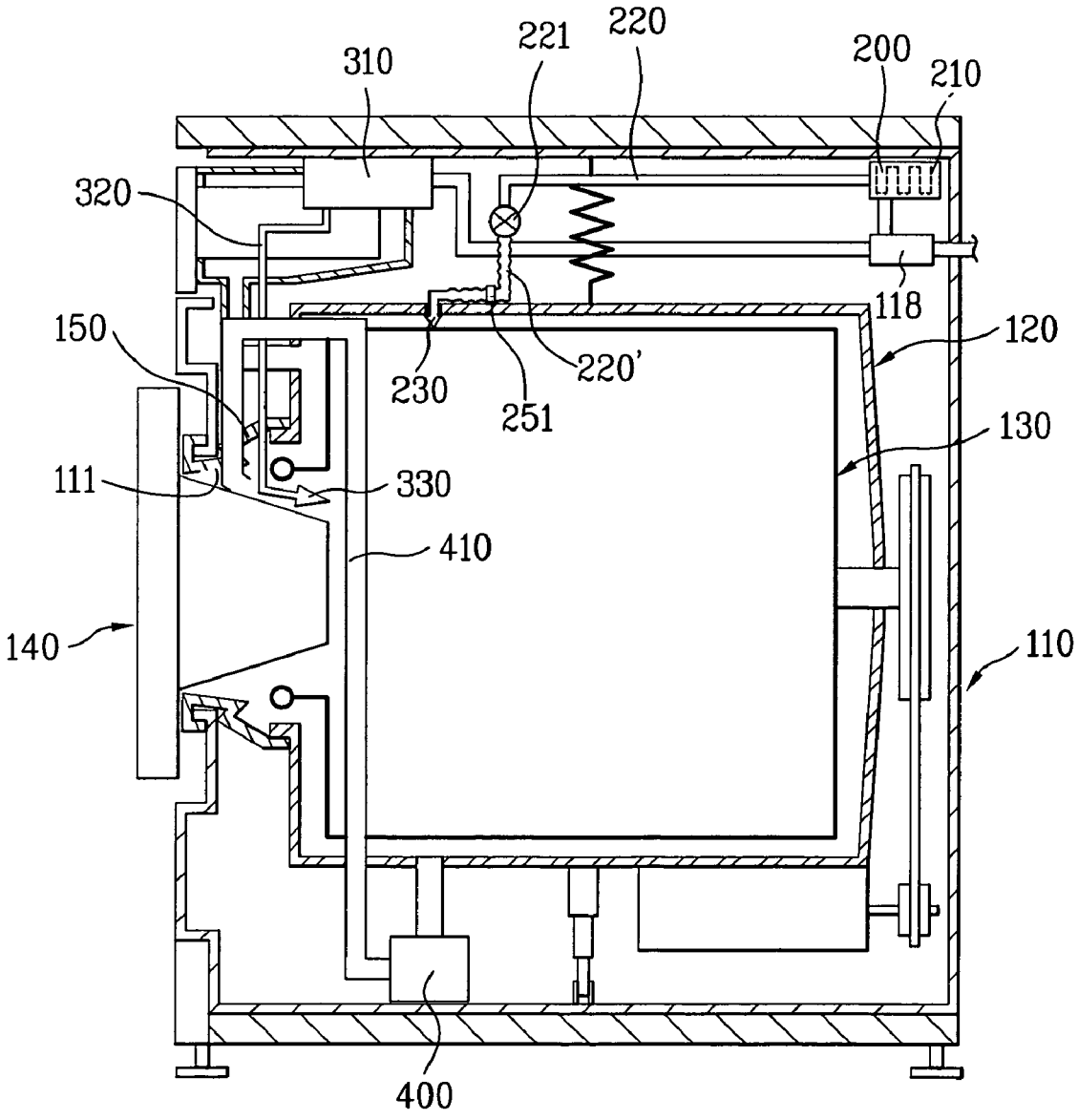

FIGS. 3 and 4 show a drum-type washing machine according to an embodiment of the present invention.

The inventive washing machine includes a main body 110 defining an outer appearance, a tub 120 disposed and supported in the main body 110, a drum 130 rotatably installed in the tub 120, one or more steam generating unit 200 providing a predetermined amount of steam into the drum 130, and a circulation pump 400 circulating washing water exhausted from the tub 120 to a side of the tub 120.

An opening of the drum 130 is oriented toward a laundry loading opening 111 of the main body 110.

At this point, a door 140 for opening/closing the laundry loading opening 111 is mounted around the laundry loading opening 111 of the main body 110. A gasket 150 is mounted on an inner circumference of the laundry loading opening 111 to provide a seal between the laundry loading opening 111 and the door 140.

In addition, the drum 130 is provided with a plurality of through holes (not shown) so that washing water and steam can be introduced into the drum 130 through the through holes.

In the drum-type washing machine of the present invention, a dispenser 310 for supplying washing water into the tub 130 is connected to a water supply valve 118. The steam generating unit 200 is also connected to the water supply valve 118.

The water supply valve 118 is connected to a tap-water tube (not shown) to control of the supply of the tap-water.

The steam generating unit 200 is provided to hot washing water into the drum 130.

Figure 7:
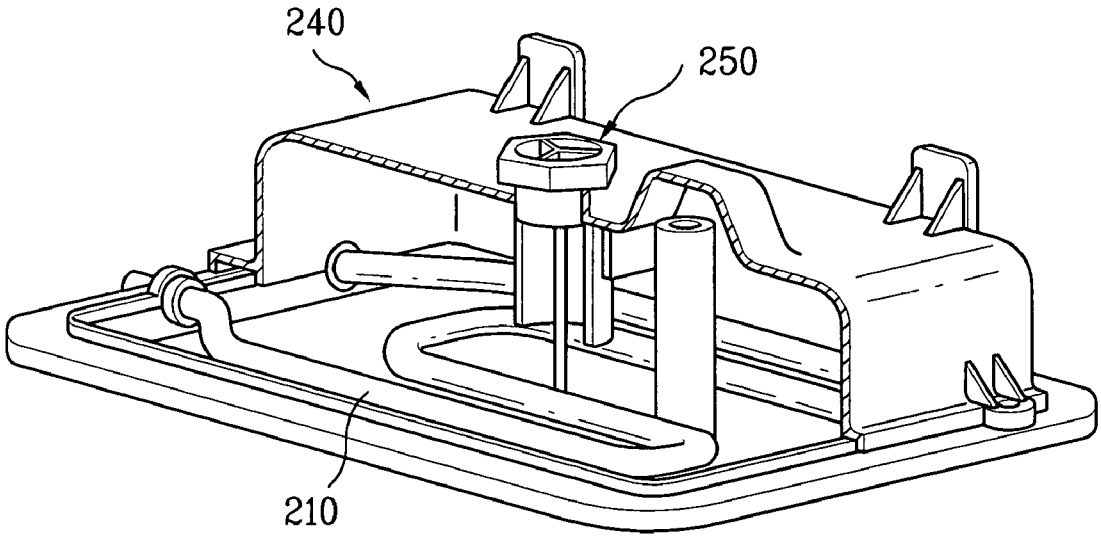
FIG. 7 illustrates an internal structure of a steam generating unit of a drum-type washing machine of the present invention.

The steam generating unit 200, as shown in FIG. 7, includes a water storing tank 240 storing the water introduced through the water supply valve 118 and a heater 210 installed in the water storing tank 240 to vaporize the water by heating the water.

FIG. 7 shows an internal structure of the steam generating unit of the inventive drum-type washing machine.

The steam generating unit 200 includes a steam supply tube 220 supplying the steam generated by the heater 210 to the tub 120 and a first spray nozzle 230 provided on an end of the steam supply tube 220.

At this point, the first spray nozzle 230 is formed in a nozzle-shape so that the steam can be effectively sprayed. An extreme end of the nozzle 230 is preferably exposed into the tube 120 by penetrating the tub 120.

The steam supply tube 220 is located above the tub 120 such that the laundry loaded in the drum 130 may not directly contact the hot air. In this case, the steam supply tube 220 may be designed such that the steam can be directly directed into the drum 130 through the gasket 150 on the front portion of the tub 120.

The heater 210 of the steam generating unit 200 may be of a coil heater wound around the steam supply tube 220 or, as shown in FIG. 7, of a sheath heater mounted in the water storing tank 240 to directly heat the water stored in the tank 240.

When the sheath heater is used, a water level sensor for detecting the water level of the tank 240 is further provided.

That is, when the water level is not enough high, the heater 210 is excessively heated. When the water level is too high, the vaporizing time is increased. Furthermore, since liquid water may be sprayed, the water level should be maintained at a predetermined level.

That is, when the water level detected by the water level sensor 250 is higher than a reference level, the water supply to the tank 240 is stopped. When the water level detected by the water level sensor 250 is lower than the reference level, the water is supplied to the tank 240.

Meanwhile, the volume of the steam generating unit 200 (i.e., the volume of the tank 240) to the volume of the drum 130 may be 1:1/30-1:1/120 so that a proper amount of steam can be supplied to the drum for the effective washing.

In order for the steam to be forcedly directed from the steam supply tube 220 into the drum 130, the first spray nozzle 230 may be connected to a pumping unit such as a pump. However, by further providing an on/off valve 221 for turning on/off the steam supply tube 220 on the tube 220, the steam can be selectively sprayed.

Meanwhile, the steam supply tube 220 has a bellows 220' to be stably fixed even when the vibration is transmitted from the tub 120 during the operation of the washing machine. The bellows 220' may be formed of rubber.

The steam supply tube 220 may be fastened on the tub 120 by a clamp 251.

In addition, the dispenser 310 connected to the water supply valve 118 to supply the washing water into the tub 210 is provided in the main body 110. The dispenser 310 is designed to add the detergent.

In addition, the dispenser 310 includes a second spray nozzle 330 spraying the stored detergent into the drum 130 and a detergent supply tube 320 guiding the detergent to the second spray nozzle 330.

At this point, an extreme end of the second spray nozzle 330 may be exposed into the drum 130.

The second spray nozzle 330 may be integrally formed with the first spray nozzle 230 of the steam generating unit 300.

An amount of water supply per minute of the water supply valve 118 to the dispenser 310 is designed to be greater than an amount of water supply per minute of the water supply valve 118 to the steam generating unit 200.

The circulating pump 400 is provided on the lower portion of the drum-type washing machine to circulate the water supplied.

A fluid circulating tube 410 for sucking the washing water exhausted to a lower portion of the tub 120 and directing the sucked washing water to the other side of the circulating pump 400 is disposed between the circulating pump 400 and the tub 120.

That is, the circulating pump 400 pumps out the washing water introduced. The washing water pumped out by the circulating pump 400 is directed into the tub 120 through a front-upper portion of the tub 120, ascending along the fluid circulating tube 410.

By directing the washing water accumulated on the bottom of the tub 120 into the drum 130, the laundry can be uniformly wet and washing water can be saved.

In this case, a filter (not shown) for filtering foreign objects contained in the washing water may be further provided on the circulating pump 400 or the fluid circulating tube 410.

A drain pump (not shown) for draining the washing water after the washing and rinsing cycles are completed is installed on a lower portion of the washing machine.

Figure 5:
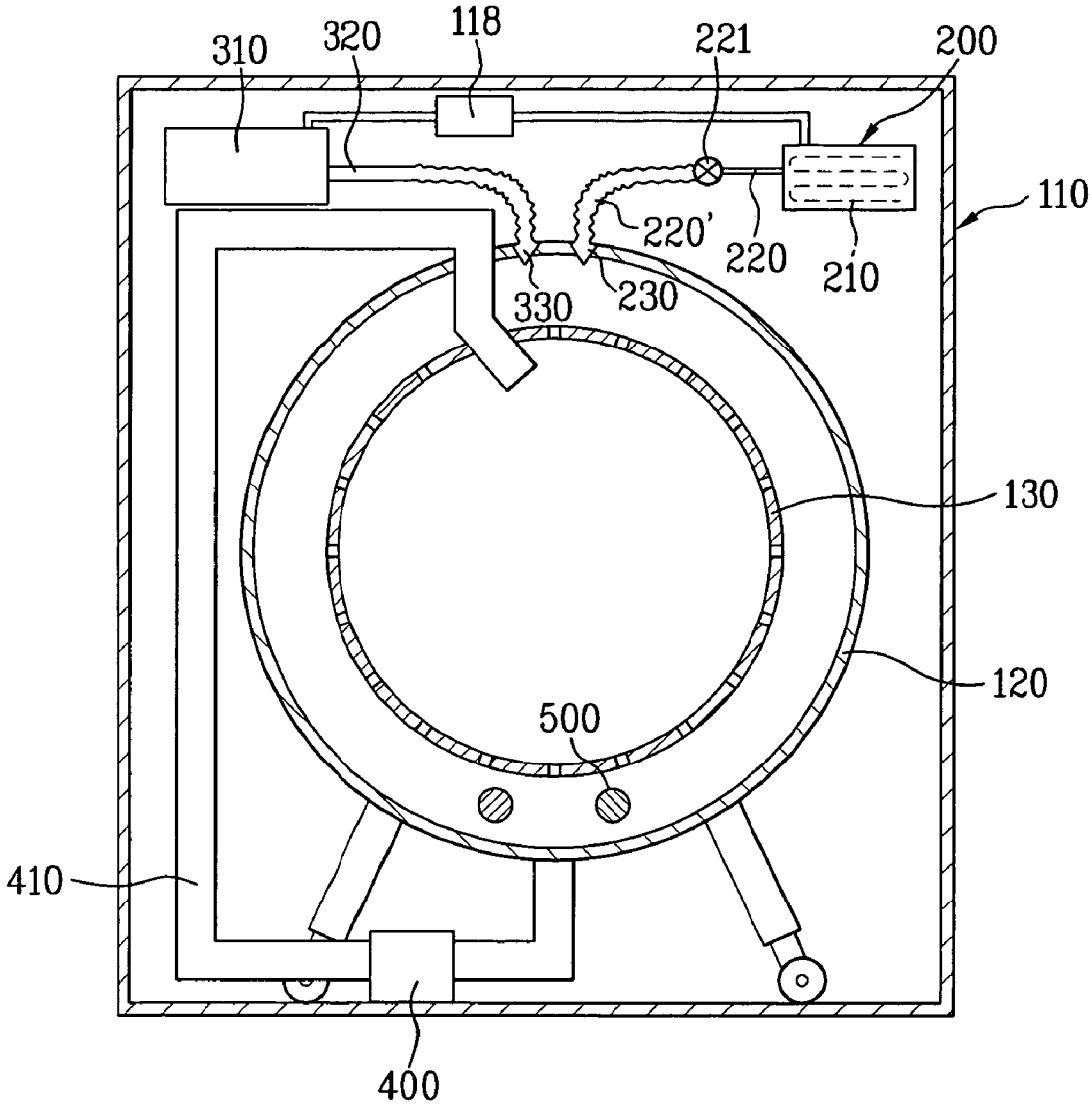
FIG. 5 illustrate an internal structure of a drum-type washing machine according to another embodiment of the present invention.

FIG. 5 shows a structure for effectively separating the polluting substances from the laundry socked in the washing water by the washing machine with the steam generating unit according to the present invention.

The structure depicted in FIG. 5 is identical to that depicted in FIGS. 3 and 4 except that a heater 500 is provided under the tub 120 to boil the laundry.

In this case, the heater 500 functions to boil the laundry by heating the washing water supplied to the tub, thereby effectively separating the polluting substances from the laundry by cooperating with the steam generating unit 200.

A washing machine having the above-described structure but further having a dry function will be described hereinafter.

Figure 6:
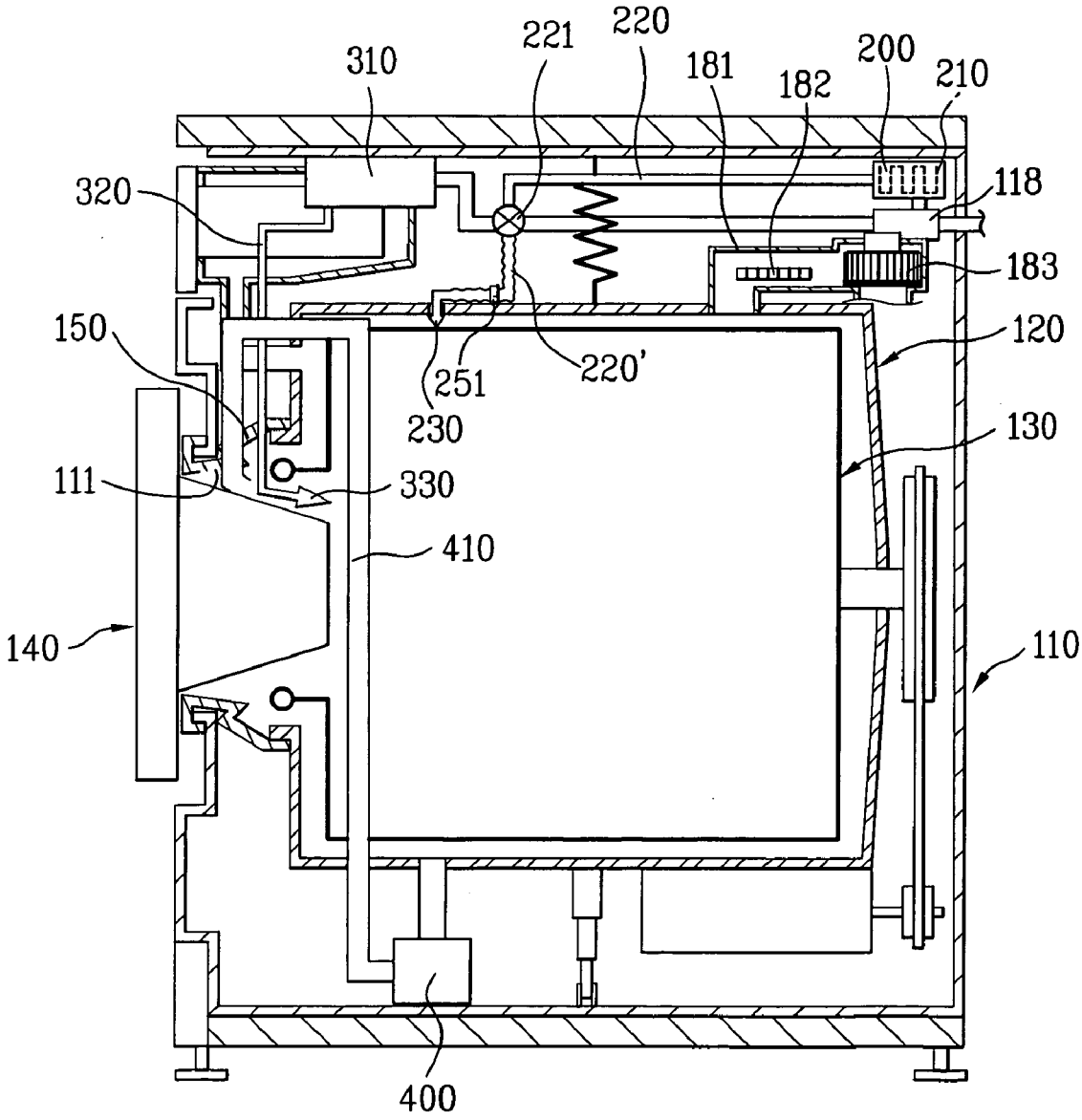
FIG. 6 illustrate an internal structure of a drum-type washing machine according to another embodiment of the present invention.

FIG. 6 shows a drum-type washing machine according to another embodiment of the present invention.

A washing machine includes a main body 110 defining an outer appearance, a tub 120 disposed and supported in the main body 110, a drum 130 rotatably installed in the tub 120 and provided with a plurality of through holes, one or more steam generating unit 200 providing a predetermined amount of steam into the drum 130, a circulation pump 400 circulating washing water exhausted from the tub 120 to a side of the tub 120, and a dry unit for drying the laundry after the washing/rinsing operation is finished.

An opening of the drum 130 is oriented toward a laundry loading opening 111 of the main body 110.

At this point, a door 140 for opening/closing the laundry loading opening 111 is mounted around the laundry loading opening 111 of the main body 110. A gasket 150 is mounted on an inner circumference of the laundry loading opening 111 to provide a seal between the laundry loading opening 111 and the door 140.

In addition, the drum 130 is provided with a plurality of through holes (not shown) so that washing water and steam can be introduced into the drum 130 through the through holes.

In the drum-type washing machine of the present invention, a dispenser 310 for supplying washing water and steam into the tub 130 is connected to a water supply valve 118. The steam generating unit 200 is also connected to the water supply valve 118.

The water supply valve 118 is connected to a tap-water tube (not shown) to control of the supply of the tap-water.

The water supply valve 118 is designed to simultaneously supply the water to both the steam generating unit 200 and the dispenser 310 or to selectively supply the water to one of the steam generating unit 200 and the dispenser 310.

The steam generating unit 200 is provided to hot washing water into the drum 130.

The steam generating unit 200, as shown in FIG. 7, includes a water storing tank 240 storing the water introduced through the water supply valve 118 and a heater 210 installed in the water storing tank 240 to vaporize the water by heating the water.

FIG. 7 shows an internal structure of the steam generating unit of the inventive drum-type washing machine.

The steam generating unit 200 includes a steam supply tube 220 supplying the steam generated by the heater 210 to the tub 120 and a first spray nozzle 230 provided on an end of the steam supply tube 220.

At this point, the first spray nozzle 230 is formed in a nozzle-shape so that the steam can be effectively sprayed. An extreme end of the nozzle 230 is preferably exposed into the tube 120 by penetrating the tub 120.

The steam supply tube 220 is located above the tub 120 such that the laundry loaded in the drum 130 may not directly contact the hot air. In this case, the steam supply tube 220 may be designed such that the steam can be directly directed into the drum 130 through the gasket 150 on the front portion of the tub 120.

In order for the steam to be forcedly directed from the steam supply tube 220 into the drum 130, the first spray nozzle 230 may be connected to a pumping unit such as a pump. However, by further providing a first on/off valve 221 for opening and closing the steam supply tube 220 on the tube 220, the steam can be selectively sprayed.

At this point, a first side of the water storing tank 240 is connected to the water supply valve 118 connected to a tap-water pipe and a second side of the water storing tank 240 is connected to the steam supply tube 220.

The heater 210 of the steam generating unit 200 may be of a coil heater wound around the steam supply tube 220 or a sheath heater mounted in the water storing tank 240 to directly heat the water stored in the tank 240.

When the sheath heater is used, a water level sensor 250 for detecting the water level of the tank 240 is further provided in the steam generating unit 200 as shown in FIG. 7.

That is, when the water level is not enough high, the heater 210 is excessively heated. When the water level is too high, the vaporizing time is increased. Furthermore, since liquid water may be sprayed, the water level should be maintained at a predetermined level.

That is, when the water level detected by the water level sensor 250 is higher than a reference level, the water supply to the tank 240 is stopped. When the water level detected by the water level sensor 250 is lower than the reference level, the water is supplied to the tank 240.

Meanwhile, the volume of the steam generating unit 200 (i.e., the volume of the tank 240) to the volume of the drum 130 may be 1:1/30-1:1/120 so that a proper amount of steam can be supplied to the drum for the effective washing.

In order for the steam to be forcedly directed from the steam supply tube 220 into the drum 130, the first spray nozzle 230 may be connected to a pumping unit such as a pump. However, by further providing an on/off valve 221 for turning on/off the steam supply tube 220 on the tube 220, the steam can be selectively sprayed.

Meanwhile, as shown in FIG. 6, the steam supply tube 220 has a bellows 220' to be stably fixed even when the vibration is transmitted from the tub 120 during the operation of the washing machine. The bellows 220' may be formed of rubber.

The steam supply tube 220 may be fastened on the tub 120 by a clamp 251.

In addition, the dispenser 310 connected to the water supply valve 118 to supply the washing water into the tub 210 is provided in the main body 110. The dispenser 310 is designed to add the detergent.

In addition, the dispenser 310 includes a second spray nozzle 330 spraying the stored detergent into the drum 130 and a detergent supply tube 320 guiding the detergent to the second spray nozzle 330.

At this point, an extreme end of the second spray nozzle 330 may be exposed into the drum 130.

More preferably, the extreme end of the second spray nozzle 330 is exposed into the drum 130, penetrating a portion (i.e., the gasket) through which the laundry is loaded in the drum.

In order for the detergent to be forcedly directed from the dispenser 310 into the drum 130, the second spray nozzle 330 may be connected to a pumping unit such as a pump. However, by further providing an on/off valve 221 for opening/closing the detergent supply tube 320 on the tube 320, the detergent can be selectively supplied.

The second spray nozzle 330 may be integrally formed with the first spray nozzle 230 of the steam generating unit 300.

An amount of water supply per minute of the water supply valve 118 to the dispenser 310 is designed to be greater than an amount of water supply per minute of the water supply valve 118 to the steam generating unit 200.

The circulating pump 400 is provided on the lower portion of the drum-type washing machine to circulate the water supplied.

A fluid circulating tube 410 for sucking the washing water exhausted to a lower portion of the tub 120 and directing the sucked washing water to the other side of the circulating pump 400 is disposed between the circulating pump 400 and the tub 120.

That is, the circulating pump 400 pumps out the washing water introduced. The washing water pumped out by the circulating pump 400 is directed into the tub 120 through a front-upper portion of the tub 120, ascending along the fluid circulating tube 410.

By directing the washing water accumulated on the bottom of the tub 120 into the drum 130, the laundry can be uniformly wet and washing water can be saved.

In this case, a filter (not shown) for filtering foreign objects contained in the washing water may be further provided on the circulating pump 400 or the fluid circulating tube 410.

A drain pump (not shown) for draining the washing water after the washing and rinsing cycles are completed is installed on a lower portion of the washing machine.

The drum-type washing machine of this embodiment further includes the dry unit. The dry unit includes a hot wind supply tube 181 supplying high temperature/dry air into the drum 130 and a dry heater 182 heating the air flowing along the hot wind supply tube 181.

At this point, a flower fan 183 is provided on the hot wind supply tube 181 to forcedly direct the air out of the hot wind supply tube 181.

The operation and control method of the above-described washing machine will be described hereinafter.

Figure 8:
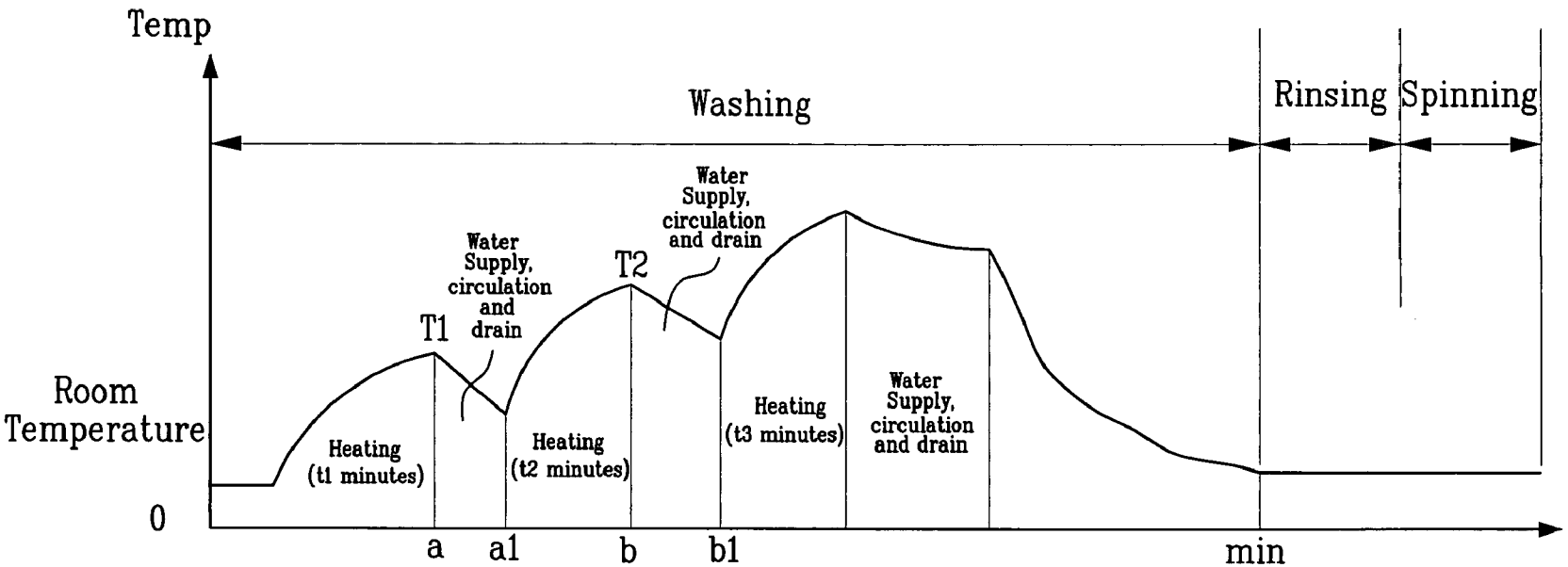
FIG. 8 illustrates a graph showing a temperature variation in a drum during an washing operation of a drum-type washing machine of the present invention.
Figure 9:
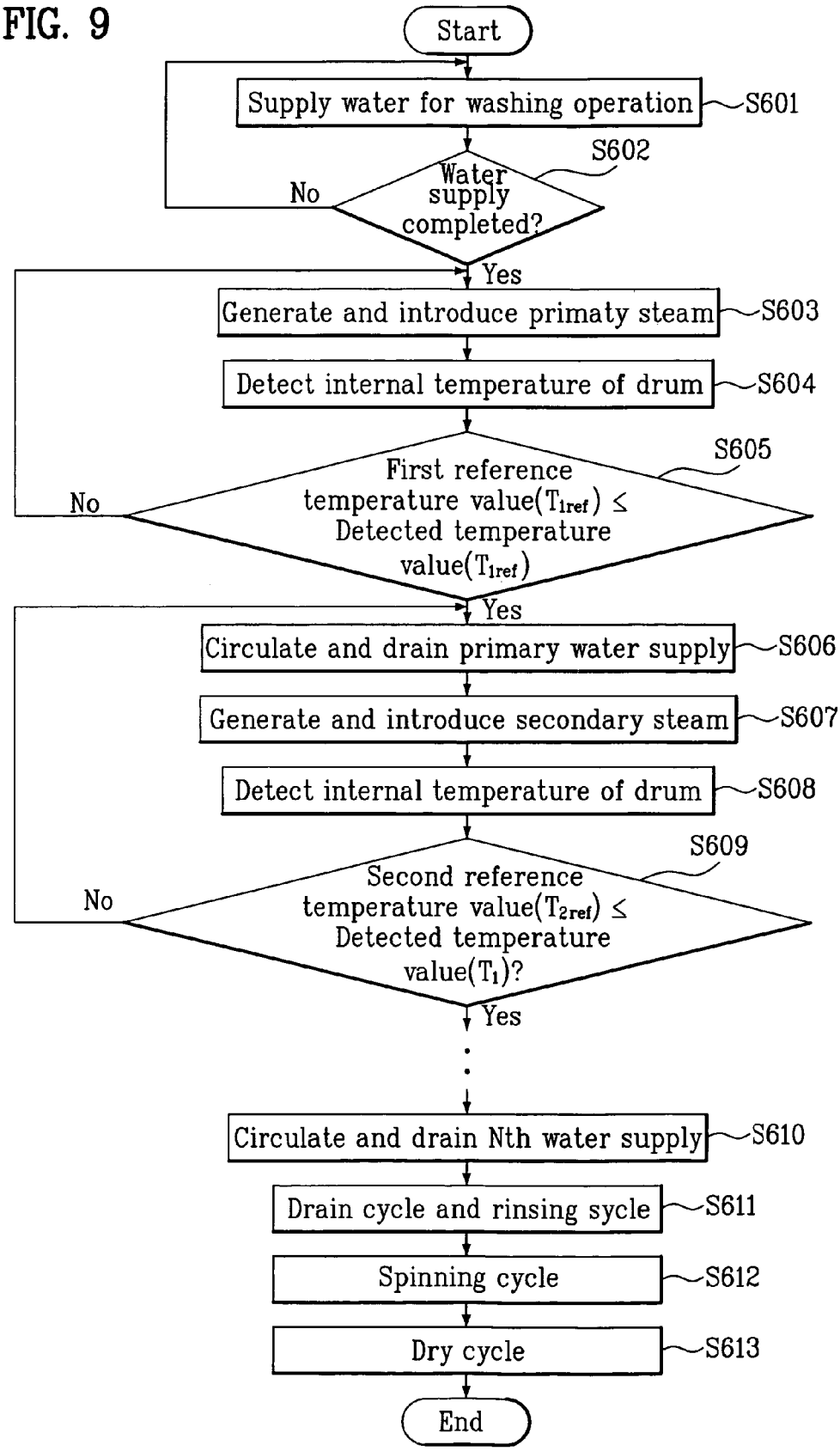
FIG. 9 illustrates a flowchart of a method for controlling a drum-type washing machine of the present invention.

FIG. 8 shows a graph showing a temperature variation in a drum during a washing operation of a drum-type washing machine of the present invention and FIG. 9 illustrates a flowchart of a method for controlling a drum-type washing machine of the present invention.

When a user input a control signal to perform the washing cycle after loading the laundry into the drum, water is supplied into the tub 120 through the dispenser 310 to initiate the washing operation (S601).

When the water supply is completed (S602), the steam generating unit 200 is operated to supply the high temperature/high pressure steam into the drum 130 for a predetermined time (a) to soak the laundry (S603).

In this case, as shown in FIG. 8, the temperature in the drum 130 is gradually increased to T1 by the steam supplied.

Here, the heating for supplying the steam is continued until a current detected temperature value T1 meets a first reference temperature value T1ref by detecting the internal temperature of the drum (S640) and comparing the first reference temperature value T1ref with the detected temperature value T1 (S604).

When the current detected temperature value meets the first reference temperature value T1ref, the steam supply is stopped and the washing water is supplied again through the dispenser 310. The washing water supplied is circulated couple of times by the circulating pump 400 and then drained (S606).

Since the washing water supplied is cool water for a time (a-a1) in the graph at which the water circulation/drain process is performed, the internal temperature of the drum 130 is reduced.

After the above, the steam generating unit 200 is operated again to supply the steam into the drum 130 for a predetermined time (a1-b) to increase the temperature to T2 (S607).

That is, the internal temperature of the drum is detected (S608) and a second reference temperature value T2ref is compared with the detected temperature value T2(S609). The heating is continued until the detected temperature value T2 becomes identical to the second reference temperature value T2ref.

When the detected temperature value T2 becomes identical to the second reference temperature value T2ref, the water circulation/drain process is performed for a predetermined time (a1-b).

The above described process is repeated by n times as shown in FIG. 8, in the course of which the internal temperature of the drum is repeatedly increased and reduced.

In the final step of the washing operation, more amount of washing water than that of the foregoing steps to finally separate the stain from the laundry by being circulated by the circulation pump 400 and is then drained (S610).

When only the steam is continuously supplied for a predetermined time without the water circulation and supply process, the laundry may be damaged as the internal temperature of the drum is excessively increased. Therefore, in the present invention, the steam supply process and the water circulation/drain process are alternately performed to prevent the internal temperature in the drum is increased too high.

Since the temperature is designed to gradually slowly increased and a small amount of water is supplied and circulated during the washing operation, the washing water as well as the electricity can be saved.

In this case, it is preferable that the drum is rotated with low speed during the steam supply from the steam generating unit 200 in order to maximize the stain separation and soaking effect.

After the above-described washing processes are all finished, drain, rinsing (S611) and spinning (S612) cycles are processed.

When the washing machine has the dry function as shown in FIG. 6, the dry cycle is started after the spinning cycle (S612) is finished (S613).

That is, when the dry cycle is started, electric power is applied to the dry heater 182 in the hot wind supply tube 181.

At this point, the blower fan 183 forcedly ventilates the hot wind as the heater is operated.

The hot wind is directed into the tub 120 by being guided by the hot wind supply tube 181 and is then directed to the drum 130 through the through holes (not shown).

The hot wind fed to the drum 130 heats the laundry to vaporize the water contained in the laundry, in the course of which the drum 130 rotates with low speed to agitate the laundry, thereby uniformly heating the laundry and enhancing the vaporize of the water.

The vaporized water is mixed with air and exhausted to be dried. The dried air is introduced into the hot wind supply tube 181 again. This process is repeated to dry the laundry.

During the dry cycle, a predetermined amount of steam may be supplied using the steam generating unit in order to prevent the laundry from being wrinkled and to obtain the static electricity elimination effect.

As described above, by alternately repeating the steam supply process and the water circulation/drain process, the internal temperature of the drum is gradually increased to prevent the laundry from being damaged and effectively separate the stain from the laundry.

Therefore, it is required to set a repeating section of the steam supply process and the water circulation/drain process. In FIG. 9, a method for setting the repeating section by detecting the internal temperature of the drum and comparing the detected temperature with the reference temperature value is illustrated.

Alternatively, a heating time for supplying the steam may be preset, based on which the steam supply process and the water circulation/drain process are alternately repeated to gradually increase the internal temperature of the drum.

The heating times at each heating section may be preset to be identical with each other or may be preset to be gradually increased.

The above-described inventive drum-type washing machine has advantages as follows:

1. The washing water and electricity can be saved.

2. Since the steam supply process and the water circulation/drain process are alternately performed, the damage of the laundry, which may be caused by the excessively increased internal temperature of the drum, can be prevented and the stain separation from the laundry can be improved.

3. By supplying a predetermined amount of steam to the drum during the dry operation, the wrinkle of the laundry and the generation of the static electricity can be prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An operating method of a washing machine comprising:
supplying water into a drum prior to supplying steam;
supplying steam into the drum to increase an inner temperature of the drum with a steam generating unit;
stopping the steam supplying step; and
repeating the steam supplying step and the stopping the steam supplying step to increase the inner temperature of the drum,
wherein the inner temperature of the drum after repeating the steam supplying step and the stopping the steam supplying step is higher than after the first stopping the steam supplying step, and
wherein water is supplied into the drum during the stopping the steam supplying steps.

2. The method of claim 1, wherein the steam is supplied for a preset time during the steam supplying step.

3. The method of claim 1, wherein, during the steam supply step, the steam is supplied until the inner temperature of the drum meets a preset temperature.

4. The method of claim 3, wherein the preset temperature is increased according to the repetition of the steam supplying step.

5. The method of claim 1, wherein the drum rotates to agitate laundry during the steam supplying step.

6. The method of claim 1, wherein, during the stopping the steam supplying step, the steam is not supplied into the drum.

7. The method of claim 1, further comprising draining water inside the drum during the stopping the steam supplying step.

8. The method of claim 1, further comprising circulating the water with a circulation pump during the stopping the steam supplying step.

9. The method of claim 1, further comprising draining water inside the drum after repeating the step of supplying water and the step of circulating water during the stopping the steam supplying step.

10. The method of claim 1, the water supplying during the stopping the steam supplying steps includes circulating the water with a circulation pump during the stopping the steam supplying step.

11. An operating method of a washing machine comprising:
a laundry washing process comprising:
supplying water into a drum prior to supplying steam;
supplying steam into the drum to increase an inner temperature of the drum with a steam generating unit;
stopping the steam supplying step; and
repeating the steam supplying step and the stopping the steam supplying step to increase the inner temperature of the drum, the inner temperature of the drum after the latter repeating steps being higher than after the previous repeating steps,
wherein water is supplied into the drum during the stopping the steam supplying steps; and
a laundry drying process with a dry unit after the laundry washing process is finished.

12. The method of claim 11, wherein the laundry drying process comprises supplying steam into the drum to reduce wrinkles and static electricity of the laundry.

13. The method of claim 11, the water supplying during the stopping the steam supplying steps includes circulating the water with a circulation pump during the stopping the steam supplying step.

14. An operating method of a washing machine comprising:
supplying steam as a heating and moisture supplying source into a drum to increase an inner temperature of the drum with a steam generating unit;
stopping the steam supplying step, wherein water is supplied into the drum during the stopping the steam supplying step; and
repeating the steam supplying step and the stopping the steam supplying step to increase the inner temperature of the drum, wherein the inner temperature of the drum after the steam supplying step is increased according to the repetition of the steam supplying step, and wherein water is supplied into the drum during the stopping the steam supplying step.

15. The method of claim 14, wherein the steam is supplied for a preset time during the steam supplying step.

16. The method of claim 14, wherein, during the steam supplying step, the steam is supplied until the inner temperature of the drum meets a preset temperature.

17. The method of claim 14, wherein, during the stopping the steam supplying step, the steam is not supplied into the drum.

18. The method of claim 14, the water supplying during the stopping the steam supplying steps includes circulating the water with a circulation pump during the stopping the steam supplying step.

* * * * *